US005669109A

United States Patent [19]

Fehrer

[11] Patent Number: 5,669,109

[45] Date of Patent: Sep. 23, 1997

[54] METHOD AND APPARATUS FOR LAYERING A FIBROUS WEB

[76] Inventor: Ernst Fehrer, Auf der Gugl 28, A-4020 Linz, Austria

[21] Appl. No.: 653,756

[22] Filed: May 23, 1996

[30] Foreign Application Priority Data

May 26, 1995 [AT] Austria ..... 888/95
Jul. 31, 1995 [AT] Austria ..... 1303/95

[51] Int. Cl.[6] ..... B65H 35/00; B65H 51/16; B65H 61/00

[52] U.S. Cl. ..... 19/163; 19/296; 271/94

[58] Field of Search ..... 19/163, 296; 271/7, 271/11, 12, 10.09, 10.1, 90, 94

[56] References Cited

U.S. PATENT DOCUMENTS 3,405,934 10/1968 Elsas ..... 271/7 X
3,431,139 3/1969 Stroszynski ..... 271/94 X
4,481,694 11/1984 Dilo ..... 19/296
5,064,341 11/1991 Pippin ..... 271/94 X
5,090,676 2/1992 Matsuno et al. ..... 271/94 X
5,429,347 7/1995 Leonard ..... 271/94

FOREIGN PATENT DOCUMENTS 0 398 240 11/1990 European Pat. Off. .

*Primary Examiner*—John J. Calvert
*Attorney, Agent, or Firm*—Collard & Roe, P.C.

[57] ABSTRACT

A method of layering a fibrous web in overlapping layers on a draw-off conveyor along a predetermined layering distance comprises the steps of sub-dividing the fibrous web into layer sections corresponding in length to the layering distance, sequentially aspirating the layer sections by suction force against the force of gravity onto a lower strand of a continuously revolving layering conveyor extending over the layering distance and conveying the layers in a conveying direction, subsequently detaching the layer sections from the lower layering conveyor strand conveying the layer sections by interrupting the suction force, and depositing the detached layer sections only in a layering direction of the draw-off conveyor.

9 Claims, 1 Drawing Sheet

METHOD AND APPARATUS FOR LAYERING A FIBROUS WEB

BACKGROUND OF THE INVENTION

1. Field of the Invention

The present invention relates to a method and apparatus for layering a fibrous web which is deposited in overlapping layers on a draw-off conveyor along a predetermined layering distance by means of a layering conveyor revolving continuously above the draw-off conveyor.

2. Description of the Prior Art

The layering arrangements of conventional apparatus for layering a fibrous web have a layering carriage which may be driven back and forth along the layering distance and is equipped with a revolving layering conveyor. The fibrous web is continuously delivered by a further carriage to the upper conveyor strand of the layering conveyor and is removed by means of layering drums moved with the layering carriage to be deposited on a draw-off conveyor arranged below the layering carriage. The construction of such layering arrangements is quite expensive, in addition to which these layering methods have the substantial disadvantage that the required back-and-forth movement of the layering carriage causes relatively large masses to be accelerated and decelerated, which leads to high energy requirements for the drive at higher layering speeds. This leads to a limitation of the layering speed so that the operating speed of the conventional layering arrangements is less than that of the carding arrangements for the manufacture of the fibrous webs.

In addition to the conventional layering carriages, a layering arrangement which is drivable back and forth transversely to the draw-off conveyor is known from U.S. Pat. No. 4,481,694. The layering arrangement is comprised of two rolls continuously rotating in opposite directions and between which the fibrous web is deposited on the draw-off conveyor. The fibrous web is delivered to this layering arrangement by a revolving conveyor whose lower strand is under vacuum so that the fibrous web is transferred from the upper to the lower conveyor strand without the fibrous web falling off the lower strand. A diaphragm, which interrupts the vacuum, is moved with the layering arrangement to detach the fibrous web from the lower conveyor strand of the stationary revolving conveyor. The revolving conveyor must be driven at double the conveying speed of the delivery arrangement so that the fibrous web may be deposited from the delivery side of the conveyor strand on the draw-off conveyor with the conveying speed of the layering arrangement. The revolving conveyor is stopped at the end of the layering distance and the layering arrangement is moved back whereby a further fibrous web layer is applied in the opposite direction of the preceding layer. A continuous delivery of the fibrous web by a delivery conveyor requires a storage device between the revolving conveyor and the delivery conveyor because the revolving conveyor is not driven continuously. The storage device is constituted by a reciprocable loop roll which receives the fibrous web from the lower strand of the delivery conveyor and deposits it on the upper strand of the revolving conveyor. A diaphragm moving with the loop roll causes the fibrous web sucked onto the lower strand of the delivery conveyor to be detached. Again, considerable masses must be accelerated and decelerated because of the reciprocatingly driven layering arrangement and the similarly reciprocatingly driven loop roll. In addition, the revolving conveyor must be accelerated to double the conveying speed of the layering arrangement for the application of one layer and the application of the succeeding layer.

SUMMARY OF THE INVENTION

It is an object of this invention to improve the first-described method of layering a fibrous web so that the layering speeds may be substantially raised and may be, for example, conformed to the speeds of manufacturing the fibrous web.

The invention accomplishes the above and other objects by sub-dividing the fibrous web into layer sections of a length corresponding to the layering distance before the individual layer sections are sequentially aspirated against the force of gravity onto a lower strand of a layering conveyor extending over the layering distance, subsequently detaching the individual layer sections from the lower layering conveyor strand during the conveyance thereof along the layering distance in a direction opposite the conveying direction by interrupting the suction forces, and depositing the detached individual layer sections on a draw-off conveyor only in the conveying direction of the draw-off conveyor.

Because the fibrous web is aspirated against the gravity force on the lower strand of the layering conveyor, the fibrous web may be dropped at any point of the layering distance without having to move the layering conveyor itself back and forth along the layering distance. The lower conveyor strand only has to extend over the layering distance and has to be driven continuously at a conveying speed corresponding to double the layering speed to be able to deposit the continuously delivered fibrous web on the draw-off conveyor in the conveying direction of the layering conveyor at a detaching speed corresponding to the layering speed. Because the layering direction constantly corresponds to the conveying direction of the layering conveyor, the fibrous web must be sub-divided into separate layer sections of a length corresponding to the layering distance, and the layer sections may be deposited sequentially on the draw-off conveyor, with the advantage that no loops are formed at the edges as is the case with back-and-forth layering. The sub-dividing of the fibrous web may be carried out in any conventionally accepted manner mechanically or aerodynamically.

For gravity to cause the detachment of the aspirated layer sections of the fibrous web from the underside of the lower conveyor strand, it is only necessary to interrupt the aspiration of the layer sections to the conveyor strand at a respective discharge point. For this purpose, a comparatively simple control may be provided, because the detachment proceeds only in one direction and, therefore, no back-and-forth moving drives are required. This, in turn, allows high layering speeds with economical drive efficiency.

The detachment of the fibrous web from the lower strand of the layering conveyor by gravity may be supported by an air stream blast, which may be of particular advantage with fibrous webs of a low weight per unit of area to overcome adhesion forces. Furthermore, to improve the deposition of the fibrous web layers on the draw-off conveyor, the deposited fibrous web layers may be aspirated on the draw-off conveyor.

To carry out the method of layering a fibrous web according to the invention, an apparatus may be provided which comprises a revolving layering conveyor above a draw-off conveyor for depositing a continuously delivered fibrous web on the draw-off conveyor over a predetermined layering distance. The layering conveyor, which is arranged stationary in the layering direction relative to the draw-off conveyor, has an air-permeable conveyor band with a lower conveyor strand extending above the draw-off conveyor along the layering distance. A suction device is arranged adjacent a side of the lower conveyor strand facing away from the draw-off conveyor, and diaphragms of a known structure for interrupting the suction on the lower conveyor strand are associated with the suction device and are movable along the layering distance in the conveying direction at half the speed of the conveying speed of the layering conveyor. The diaphragms are spaced apart a minimum distance corresponding to half the layering distance. The diaphragms interrupt the suction on the conveyor strand so that the movement of the diaphragms along the layering distance causes the detachment points of the aspirated fibrous web sections from the conveyor strand to be displaced accordingly. A distortion-free deposition of the layer sections of the fibrous web requires the layering speed to correspond to half the conveying speed of the layering conveyor. Therefore, the diaphragms for detaching the individual layer sections of the fibrous web must be moved at the layering speed, that is half the conveying speed of the layering conveyor in the conveying direction thereof, and at a minimum spacing from each other which equals half the layering distance and thus half the length of the layer sections of the fibrous web. This minimum spacing applies to the case that the distance between the consecutively delivered layer sections of the fibrous web corresponds at most to the vertical distance between the layering conveyor and the draw-off conveyor. If the distance between the individual sections is greater, the spacing between the diaphragms must of course be increased, too, to secure an accurate deposition along the layering distance.

Since all diaphragms are moved at the same speed at a predetermined spacing, the diaphragms may be affixed to a conveyor revolving at half the speed of the layering conveyor so that only drives revolving in one direction are required, which permits not only simple construction conditions but also makes high layering speeds possible.

At least one blast nozzle oriented towards the discharge point of the layer section of the fibrous web from the conveyor strand may be associated with each diaphragm to support the fibrous web detachment from the layering conveyor. The draw-off conveyor may have an air-permeable conveyor band whose upper conveyor strand has an underside adjacent a suction device to improve the deposition of the layer sections of the fibrous web on the draw-off conveyor.

The fibrous web layer sections must be securely held on the layering conveyor against displacement to enable the fibrous web layer sections to be deposited on the draw-off conveyor without folds. For this purpose, the surface of the layering conveyor receiving the fibrous web layer sections may advantageously have a projecting brush-like nap. The projecting brush-like nap substantially increases the sliding friction between the surface of the layering conveyor and the fibrous web layer sections so that the suction force may be so adjusted solely in dependence on the weight of the fibrous web that each fibrous web layer section is aspirated on the lower layering conveyor strand with as weak a vacuum as possible. Because of the high friction between the fibrous web and the projecting brush-like nap on the layering conveyor surface, the aspirated fibrous web layer section is held against displacement relative to the layering conveyor without the projecting brush-like nap interfering with the dropping of the fibrous web layer section off the layering conveyor when the suction is interrupted.

Since the purpose is only to prevent a displacement of the fibrous web layer section relative to the surface of the layering conveyor, the projecting brush-like nap does not have to extend continuously over the entire surface. Rather, the nap may be limited to a grating pattern. The projecting brush-like nap may be produced by warp threads in a weaving technique, or by a needling process.

BRIEF DESCRIPTION OF THE DRAWING

The above and other objects, advantages and features of the present invention will become more apparent from the following description of a now preferred embodiment thereof, taken in conjunction with the accompanying schematic drawing, wherein.

DETAILED DESCRIPTION OF THE PREFERRED EMBODIMENT

Figure 1:
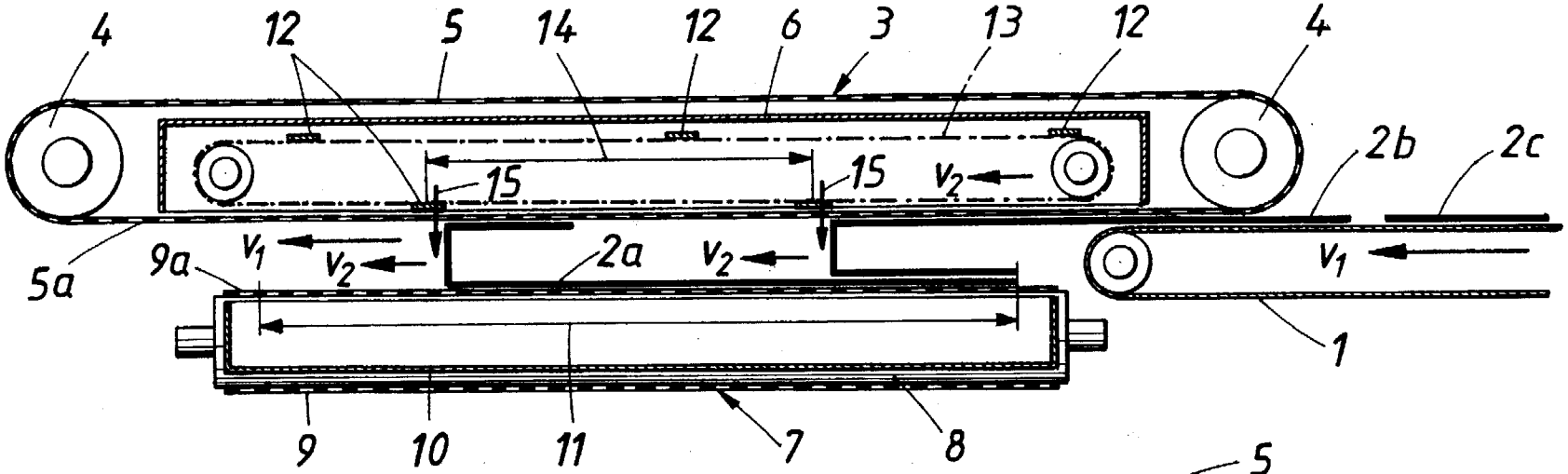
FIG. 1 shows a longitudinal section of an apparatus for layering a fibrous web according to the invention.
Figure 2:
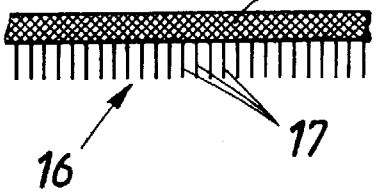
FIG. 2 shows a fragmentary section of the conveyor band of the layering conveyor, on an enlarged scale.

As shown in FIG. 1, the apparatus comprises delivery conveyor 1 for a fibrous web sub-divided into individual layer sections 2*a*, 2*b*, 2*c*, which are received from delivery conveyor 1 by a layering conveyor 3. Layering conveyor 3 is equipped with air-permeable conveyor band 5 trained over guide rollers 4, and individual layer sections 2*a*, 2*b*, 2*c* of the fibrous web are aspirated on lower conveyor strand 5*a*. For this purpose, the upper side of lower conveyor strand 5*a* is adjacent suction device 6, which is illustrated as a suction box, so that layer sections 2*a*, 2*b*, 2*c* of the fibrous web are aspirated on the underside of conveyor strand 5*a* against the force of gravity in the range of suction device 6 when delivery conveyor 1 moves them into the suction zone of suction device 6. Draw-off conveyor 7 extends transversely to the conveying direction of layering conveyor 3 and is arranged at a distance below conveyor strand 5*a* of layering conveyor 3. It also has an air-permeable, endless conveyor band 9, which is trained over guide rollers 8 whose upper conveyor strand 9*a* facing layering conveyor 3 is aspirated at the underside thereof. The suction box serving this purpose is designated 10.

Individual layer sections 2*a*, 2*b* , 2*c* of the fibrous web to be layered are sequentially deposited on draw-off conveyor 7 along layering distance 11 in overlapping layers, the overlapping being determined by the conveying movement of draw-off conveyor 7. The length of individual layer sections 2*a*, 2*b* , 2*c* must correspond to layering distance 11. The sub-division of the fibrous web into individual layer sections 2*a*, 2*b*, 2*c* may be effected in a conventional manner either mechanically or aerodynamically. To enable layer sections 2*a*, 2*b*, 2*c* to be deposited on draw-off conveyor 7 in layers, care must be taken properly to detach layer sections 2*a*, 2*b*, 2*c* aspirated on conveyor strand 5*a* and conveyed therewith over draw-off conveyor 7. To effect the detachment, it is only necessary to interrupt the suction of suction device 6. Diaphragms 12, which are affixed to revolving conveyor 13, are provided for this purpose. Since conveying speed v1 of layering conveyor 3 must correspond to double the layering speed v2 to assure a distortion-free deposition of layer sections 2*a*, 2*b*, 2*c* on draw-off conveyor 7, diaphragms 12 associated with individual layer sections 2*a*, 2*b*, 2*c* must be driven in the conveying direction of layering conveyor 3 at layering speed v2 so that the discharge points of individual layer sections 2*a*, 2*b*, 2*c* move in the conveying direction at layering speed v2. On the basis of these speed relations, spacing 14 between diaphragms 12 corresponds to half the layering distance 11 so that delivery conveyor 1 feeds individual layer sections 2a, 2b, 2c sequentially to the input end of layering distance 11 and deposits them on draw-off conveyor 7 in the conveying direction, where they are aspirated on conveyor strand 9a of draw-off conveyor 7. Because layering conveyor 3 and revolving conveyor 13 for diaphragms 12 revolve in the same direction at the same revolving speeds, relatively simple driving conditions are obtained, which permit a high layering speed v2 because no back-and-forth layering movements are required, as in conventional fibrous web layering. Of course, draw-off conveyor 7 may also extend parallel to layering conveyor 3 for longitudinally extending layering.

To support the detachment of individual layer sections 2a, 2b, 2c from conveyor strand 5a of layering conveyor 3, blast nozzles may be associated with diaphragms 12, as shown by arrows 15 indicating air stream blasts aiding in overcoming adhesion forces.

To enable the suction capacity of suction device 6 to be kept low, care must be taken to prevent a sliding movement of layer sections 2a, 2b, 2c relative to conveyor strand 5a of layering conveyor 3, despite a weak suction force. For this purpose, the surface of air-permeable conveyor band 5 of layering conveyor 3 which receives the fibrous web layer sections has projecting brush-like nap 16, which causes a corresponding increase of the sliding friction between the fibrous web and layering conveyor 3, so that layer sections 2a, 2b, 2c of the fibrous web are securely held on conveyor strand 5a despite the weak suction force. Because nap threads 17 are oriented transversely to conveyor strand 5a, the dropping of layer sections 2a, 2b, 2c from layering conveyor 3 due to gravity is not impaired when the suction is interrupted. Projecting brush-like nap threads may be produced by a weaving technique but also by a suitable needling process.

What is claimed is:

1. A method of layering a fibrous web in overlapping layers on a draw-off conveyor along a predetermined layering distance, which comprises the steps of (a) sub-dividing the fibrous web into layer sections corresponding in length to the layering distance, (b) sequentially aspirating the layer sections by suction force against the force of gravity onto a lower strand of a continuously revolving layering conveyor extending over the layering distance and conveying the layers in a conveying direction, (c) subsequently detaching the layer sections from the lower layering conveyor strand conveying the layer sections by interrupting the suction force, and (d) depositing the detached layer sections only in a layering direction of the draw-off conveyor.

2. The method of claim 1, further comprising the step of applying an air stream blast to support the detachment of the layer sections upon interruption of the suction force.

3. The method of claim 1, further comprising the step of aspirating the deposited layer sections on the draw-off conveyor.

4. An apparatus for layering a fibrous web, which comprises (a) a continuously revolving layering conveyor sequentially delivering fibrous web layer sections at a conveying speed along a predetermined layering distance in a conveying direction, the layer sections having a length corresponding to the layer distance, the layering conveyor comprising (1) a conveyor band having a lower strand extending over the layering distance, (2) suction means for aspirating the fibrous web layer sections by suction force against the force of gravity on the lower conveyor band strand, and (3) diaphragms associated with the suction means for interrupting the suction force during the delivery of the fibrous web layer sections and movable along the layering distance in the conveying direction at half the speed of the conveying speed of the layering conveyor to detach the layer sections, the diaphragms being spaced apart a minimum distance corresponding to half the layering distance, and (b) a draw-off conveyor arranged below the layering conveyor for receiving overlapping ones of the detached fibrous web layer sections only in a layering direction of the draw-off conveyor.

5. The apparatus of claim 4, further comprising a conveyor to which the diaphragms are affixed, said conveyor revolving at half the speed of the conveying speed of the layering conveyor.

6. The apparatus of claim 4, further comprising at least one blast nozzle associated with each one of the diaphragms, the blast nozzle being oriented towards a discharge point of the fibrous web layer sections from the lower layering conveyor strand.

7. The apparatus of claim 4, wherein the draw-off conveyor comprises an air-permeable conveyor band, the draw-off conveyor band having an upper conveyor band strand facing the lower layering conveyor band strand, and a suction means adjacent an underside of the upper draw-off conveyor band strand.

8. The apparatus of claim 4, wherein the layering conveyor band has a surface carrying a projecting brush-like nap.

9. The apparatus of claim 8, wherein the projecting brush-like nap is distributed over the surface in a grating pattern.

* * * * *